US008577266B2

(12) United States Patent
Shiba et al.

(10) Patent No.: US 8,577,266 B2
(45) Date of Patent: Nov. 5, 2013

(54) IMAGE FORMING APPARATUS COMPRISING A DETECTION MEMBER AND TENSION APPLYING MEMBER FACING EACH OTHER

(75) Inventors: Hiroki Shiba, Kanagawa (JP); Katsumi Shiota, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 87 days.

(21) Appl. No.: 12/862,440

(22) Filed: Aug. 24, 2010

(65) Prior Publication Data

US 2011/0229243 A1 Sep. 22, 2011

(30) Foreign Application Priority Data

Mar. 16, 2010 (JP) ..... 2010-059740

(51) Int. Cl.
*G03G 15/20* (2006.01)
*G03G 15/00* (2006.01)

(52) U.S. Cl.
USPC ..... 399/308; 399/49

(58) Field of Classification Search
USPC ..... 399/308, 121, 49, 301, 302, 74
See application file for complete search history.

(56) References Cited

U.S. PATENT DOCUMENTS

2009/0080948 A1* 3/2009 Takei ..... 399/308
2009/0129830 A1* 5/2009 Adachi et al. ..... 399/308
2010/0310283 A1* 12/2010 Okamoto ..... 399/302

FOREIGN PATENT DOCUMENTS

JP 2003248350 A * 9/2003
JP 2004-29525 A 1/2004
JP 2009-75479 A 4/2009

* cited by examiner

*Primary Examiner* — Billy J Lactaoen
(74) *Attorney, Agent, or Firm* — Sughrue Mion, PLLC

(57) ABSTRACT

An image forming apparatus of the present invention includes an endless belt that travels circularly by a drive member and has an outer peripheral surface on which an image is formed; a tension applying member around which the endless belt is trained and that applies tension to the endless belt by pressing an inner peripheral surface of the endless belt; a detection member that detects the image formed on the outer peripheral surface of the endless belt; a support member to which the detection member is attached and that movably supports the detection member with respect to an apparatus main body; and a positioning member that positions the detection member with respect to the outer peripheral surface of the endless belt at a portion pressed by the tension applying member.

18 Claims, 14 Drawing Sheets

IMAGE FORMING APPARATUS COMPRISING A DETECTION MEMBER AND TENSION APPLYING MEMBER FACING EACH OTHER

CROSS-REFERENCE TO RELATED APPLICATION

This application is based on and claims priority under 35 USC 119 from Japanese Patent Application No. 2010-059740 filed Mar. 16, 2010.

BACKGROUND

Technical Field

The present invention relates to an image forming apparatus.

SUMMARY

The present invention provides an image forming apparatus configured such that even if a detection member is disposed facing an outer peripheral surface of an endless belt at the portion pressed by a tension applying member, the distance between the detection member and the outer peripheral surface of the endless belt is kept.

An image processing apparatus of a first aspect of the invention is characterized in that the apparatus includes an endless belt that travels circularly by a drive member and has an outer peripheral surface on which an image is formed; a tension applying member around which the endless belt is trained and that applies tension to the endless belt by pressing an inner peripheral surface of the endless belt; a detection member that detects the image formed on the outer peripheral surface of the endless belt; a support member to which the detection member is attached and that movably supports the detection member with respect to an apparatus main body; and a positioning member that positions the detection member with respect to the outer peripheral surface of the endless belt at a portion pressed by the tension applying member.

BRIEF DESCRIPTION OF THE DRAWINGS

Exemplary Embodiment of the present invention will be described in detail based on the following figures, wherein.

DETAILED DESCRIPTION

Figure 1:
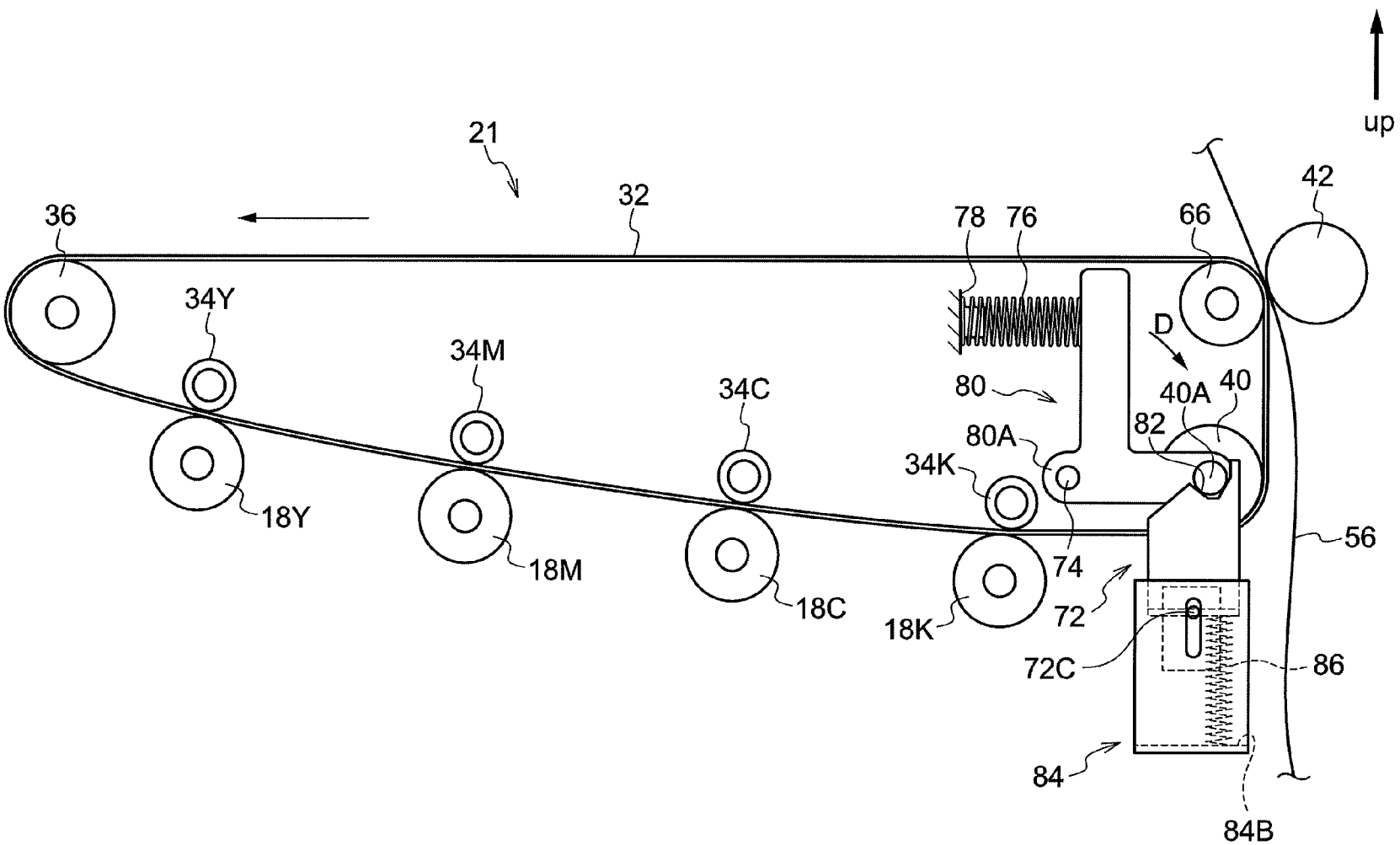
FIG. 1 is a side elevational view showing a primary transfer unit employed to an image forming apparatus according to an exemplary embodiment of the invention.

An example an image forming apparatus according to an exemplary embodiment of the present invention will be explained referring to FIG. 1 to FIG. 14. Note that an arrow UP in the drawings shows a vertical direction.

(Overall Configuration)

Figure 14:
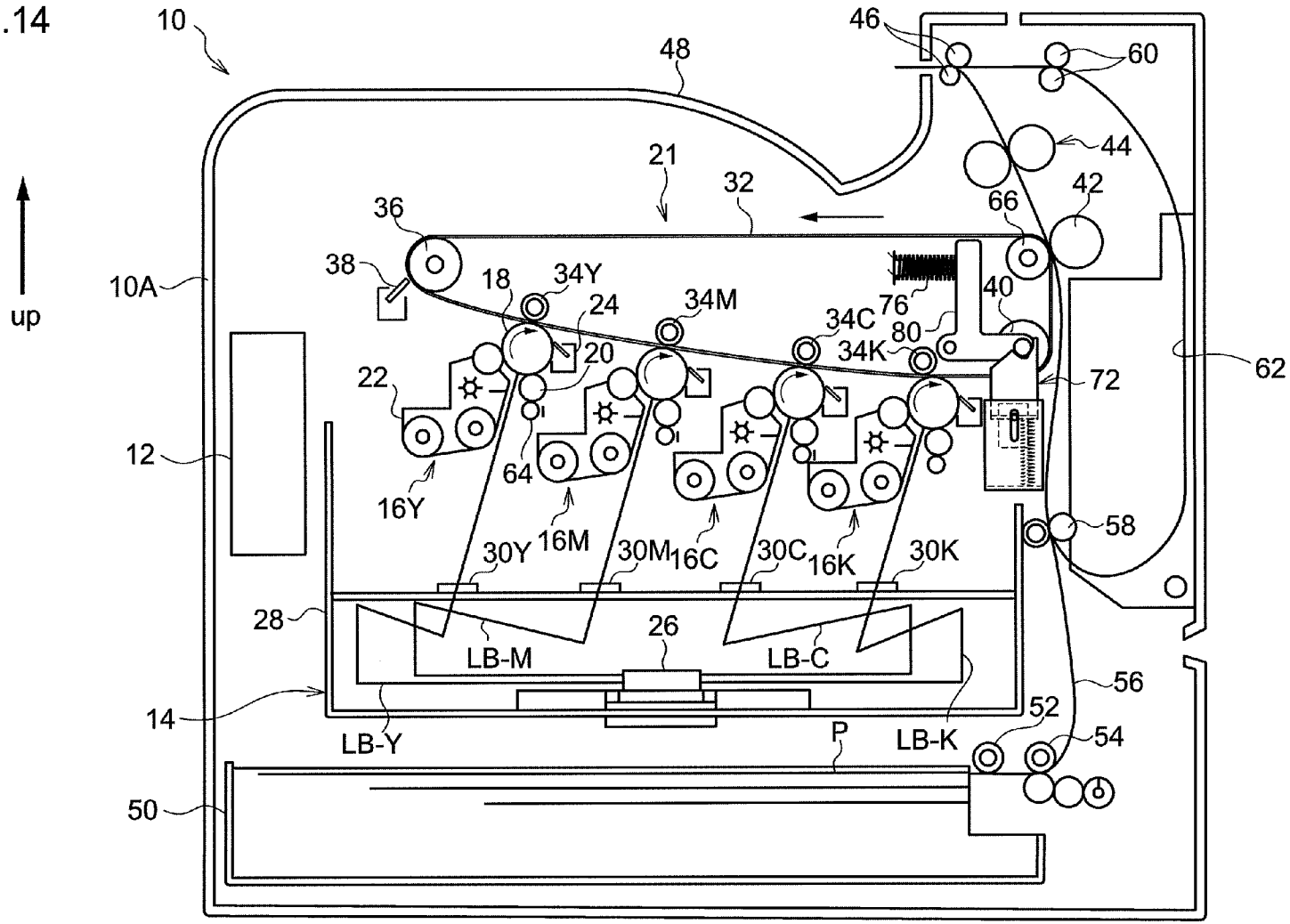
FIG. 14 is a schematic configuration view showing the image forming apparatus according to the exemplary embodiment of the invention.

As shown in FIG. 14, an image processing section 12, which processes an image to image data, is disposed in an apparatus main body 10A of the image forming apparatus 10.

The image processing section 12 processes input image data to gradation data of four colors of yellow (Y), magenta (M), cyan (C), and black (K), and an exposure device 14, which receives the processed gradation data and exposes an image by a laser beam LB, is disposed at a central portion in the apparatus main body 10A.

Further, four image forming units 16Y, 16M, 16C, 16K of yellow (Y), magenta (M), cyan (C), and black (K) are disposed above the exposure device 14 at intervals in a horizontal direction. Note that when it is not necessary to discriminate Y, M, C, K in explanation, they may be explained omitting Y, M, C, K.

All the four image forming units 16Y, 16M, 16C, 16K are configured likewise and include columnar image holding members 18 driven in rotation at a predetermined speed, primary charging members 20 for charging outer peripheral surfaces of the image holding members 18, developing members 22 for making electrostatic latent images, which are formed on the outer peripheral surfaces of the image holding members 18 charged by the image exposure of the exposure device 14, visible as toner images by developing the electrostatic latent images by toners having predetermined colors, and cleaning blades 24 for cleaning the outer peripheral surfaces of the image holding members 18. Further, cleaning members 64 are disposed under the columnar charging members 20 in contact the charging members 20 to clean outer peripheral surfaces of the charging members 20.

Further, the exposure device 14 is provided with four semiconductor lasers (not shown in the drawings) configured commonly to the four image forming units 16Y, 16M, 16C, 16K, and laser beams LB-Y, LB-M, LB-C, LB-K are emitted from the semiconductor lasers according to the gradation data.

Note that, the laser beams LB-Y, LB-M, LB-C, LB-K emitted from the semiconductor lasers are radiated to a polygon mirror 26 as a rotary multi-face mirror via a f-θ lens which are not shown in the drawings and are deflection-scanned by the polygon mirror 26. The laser beams LB-Y, LB-M, LB-C, LB-K, which are deflection-scanned by the polygon mirror 26, are scan-exposed to an exposure point on the image holding members 18 from obliquely downward via imaging lens and plural mirrors which are not shown in the drawings.

Further, since the exposure device 14 scan-exposes images on the image holding members 18 from downward, there is a possibility that toners and the like drop onto the exposure device 14 from the developing members 22 and the like of the four image forming units 16Y, 16M, 16C, 16K located above the exposure device 14. Accordingly, a periphery of the exposure device 14 is sealed by a rectangular parallelepiped frame 28. Transparent glass windows 30Y, 30M, 30C, 30K are disposed on the frame 28 to cause the four laser beams LB-Y, LB-M, LB-C, LB-K to pass through the transparent glass windows 30Y, 30M, 30C, 30K onto the image holding members 18 of the respective image forming units 16Y, 16M, 16C, 16K.

In contrast, a primary transfer unit 21 as an example of a belt unit is disposed above the respective image forming units 16Y, 16M, 16C, 16K. The primary transfer unit 21 includes an intermediate transfer belt 32 as an example of an endless belt, a drive roll 36 around which the intermediate transfer belt 32 is trained and which is driven in rotation and causes the intermediate transfer belt 32 to circularly travel in an arrow direction, a tension applying roll 40 as an example of a tension applying member around which the intermediate transfer belt 32 is trained and by which tension is applied to the intermediate transfer belt 32, a driven roll 66 disposed above the tension applying roll 40 and driven together with the intermediate transfer belt 32, and primary transfer rolls 34Y, 34M, 34C, 34K disposed on an opposite side of image holding members 18Y, 18M, 18C, 18K with the intermediate transfer belt 32 interposed therebetween.

Then, the toner images of the respective colors of yellow (Y), magenta (M), cyan (C), black (K), which are sequentially formed on the image holding members 18 of the image forming units 16Y, 16M, 16C, 16K by the four primary transfer rolls 34Y, 34M, 34C, 34K, are transferred onto the intermediate transfer belt 32 in a multiple manner.

Further, a cleaning blade 38 for cleaning an outer peripheral surface the intermediate transfer belt 32 is disposed so as to face the drive roll 36 with the intermediate transfer belt 32 interposed therebetween. Further, a support member 72, to which a detection member 70 (refer to FIG. 2) for detecting the toner images transferred onto the intermediate transfer belt 32 is attached, is disposed at a position facing the tension applying roll 40 with the intermediate transfer belt 32 interposed therebetween. Note that the primary transfer unit 21, the detection member 70, and the like will be described later in detail.

Further, a secondary transfer roll 42 is disposed on an opposite side of the driven roll 66 with the intermediate transfer belt 32 interposed therebetween. The toner images of the respective colors of yellow (Y), magenta (M), cyan (C), black (K), which are transferred onto the intermediate transfer belt 32 in the multiple manner, are transported by the intermediate transfer belt 32, sandwiched between the driven roll 66 and the secondary transfer roll 42, and secondarily transferred onto a sheet member P as a recording medium transported along a sheet transport path 56.

Further, a fixing unit 44, which fixes the toner images transferred onto the sheet member P to sheet member P by heat and pressure, is disposed at a downstream side in a transport direction of the sheet member P with respect to the secondary transfer roll 42 (hereinafter, simply called a downstream side).

Further, discharge rolls 46, which discharge the sheet member P onto which the toner images are fixed to a discharge section 48 disposed at an upper portion of the apparatus main body 10A of the image forming apparatus 10, are disposed at a downstream side of the fixing unit 44.

In contrast, a sheet feed member 50, on which sheet members P are stacked, is disposed on a lower side of in the apparatus main body 10A of the image forming apparatus 10. Further, a sheet feed roll 52, which feeds the sheet members P stacked on the sheet feed member 50 to a sheet transport path 56, is disposed. A separation roll 54, which transports the sheet members P by separating them one by one, is disposed at a downstream side of the sheet feed roll 52. Further, an alignment roll 58 for aligning a transport timing is disposed downstream of the separation roll 54. With such a configuration, the sheet members P supplied from the sheet feed member 50 are fed to a position (secondary transfer position) where the intermediate transfer belt 32 is caused to come into contact with the secondary transfer roll 42 by the alignment roll 58 which is rotated at a predetermined timing.

Transport rolls 60 are disposed adjacent to the discharge rolls 46 to transport the sheet member P having one side on which the image is fixed by the fixing unit 44 to a both-side transport path 62 without discharging the sheet member P onto the discharge section 48 by the discharge rolls 46 as it is. Due to this operation, the sheet member P, which is transported along the both-side sheet transport path 62, is transported to the alignment roll 58 again with a front side and the back side inverted and discharged onto the discharge section 48 after the toner images are transferred and fixed onto the back side of the sheet member P.

With such a configuration, the images are formed on the sheet member P as described below.

First, the gradation data of the respective colors are sequentially output from the image processing section 12 to the exposure device 14, the laser beams. LB-Y, LB-M, LB-C, LB-K, which are emitted from the exposure device 14 according to the gradation data, are scan-exposed to the outer peripheral surfaces of the image holding members 18 charged by the charging members 20, thereby forming the electrostatic latent images on the outer peripheral surfaces of the image holding members 18. The electrostatic latent images formed on the image holding members 18 are made visible as the toner images of the respective colors of yellow (Y), magenta (M), cyan (C), black (K) by the developing members 22Y, 22M, 22C, 22K, respectively.

Further, the toner images of the respective colors of yellow (Y), magenta (M), cyan (C), black (K), which are formed on the image holding members 18 by the primary transfer rolls 34 of the primary transfer unit 21 disposed throughout above the respective image forming units 16Y, 16M, 16C, 16K, are transferred onto the circularly traveling intermediate transfer belt 32 in the multiple manner.

Further, the toner images of the respective colors which are transferred onto the circularly traveling intermediate transfer belt 32 in the multiple manner are secondarily transferred onto the sheet member P by the secondary transfer roll 42, the sheet member P being transported from the sheet feed member 50 to the sheet transport path 56 at a predetermined timing by the sheet feed roll 52, the separation roll 54, and the alignment roll 58.

Further, the sheet member P onto which the toner images are transferred is transported to the fixing unit 44. The toner images, which are transferred onto the sheet member P, are fixed onto the sheet member P by the fixing unit 44 and discharged to the discharge section 48 disposed at an upper portion of the apparatus main body 10A of the image forming apparatus 10 by the discharge rolls 46 after the toner images are fixed on the sheet member P.

Further, when the images are formed on both the sides of the sheet member P, the sheet member P having one side on which an image is fixed by the fixing unit 44 is transported to the both-side transport path 62 via the transport rolls 60 by switching a transport direction without being discharged onto the discharge section 48 by the discharge rolls 46. The front side and the back side of the sheet member P are inverted by transporting the sheet member P along the both-side transport path 62, and the sheet member P is transported to the alignment roll 58 again. At the time, the toner images are transferred and fixed onto the back side of the sheet member P, and the sheet member P is discharged onto the discharge section 48 by the discharge rolls 46 after the toner image is fixed and transferred.

(Configuration of Main Portion)

Next, the primary transfer unit 21, the detection member 70, and the like will be explained.

As shown in FIG. 1, when the respective colors are transferred onto the intermediate transfer belt 32 in the multiple manner (in a color print), the primary transfer rolls 34 of the respective colors disposed at the primary transfer unit 21 are supported by support members which are not shown in the drawings so that the intermediate transfer belt 32 is pressed to the image holding members 18. Due to this operation, the toner images of the respective colors formed on the image holding members 18 are transferred onto the intermediate transfer belt 32.

Further, both the ends of a rotating shaft 40A (including a support shaft for supporting the shaft in rotation) of the tension applying roll 40 are rotatably supported by one ends of holding members 80 formed in an L-shape when viewed from the direction of the rotating shaft 40A (hereinafter, simply called an axial direction). Further, projecting sections 80A, which project on opposite sides to the one ends of holding members 80, are disposed at corners of the holding members 80 and are rotatably supported to frame members which are not shown in the drawings by shaft sections 74. More specifically, the holding members 80 rotate and move about the shaft sections 74, and the tension applying roll 40 may move about the shaft sections 74 in an arc shape.

Further, extremity end sections of compression coil springs 76 as an example of urging members are fixed to the other ends (which are ends extending upward) of the holding members 80, and base end sections of the compression coil springs 76 are fixed to frame members 78. The holding members 80 rotate and move about the shaft sections 74, and the compression coil springs 76 urge the other ends of the holding members 80 so that the tension applying roll 40 presses the inner peripheral surface of the intermediate transfer belt 32. Due to this operation, tension is applied to the intermediate transfer belt 32 in a predetermined range.

Figure 2:
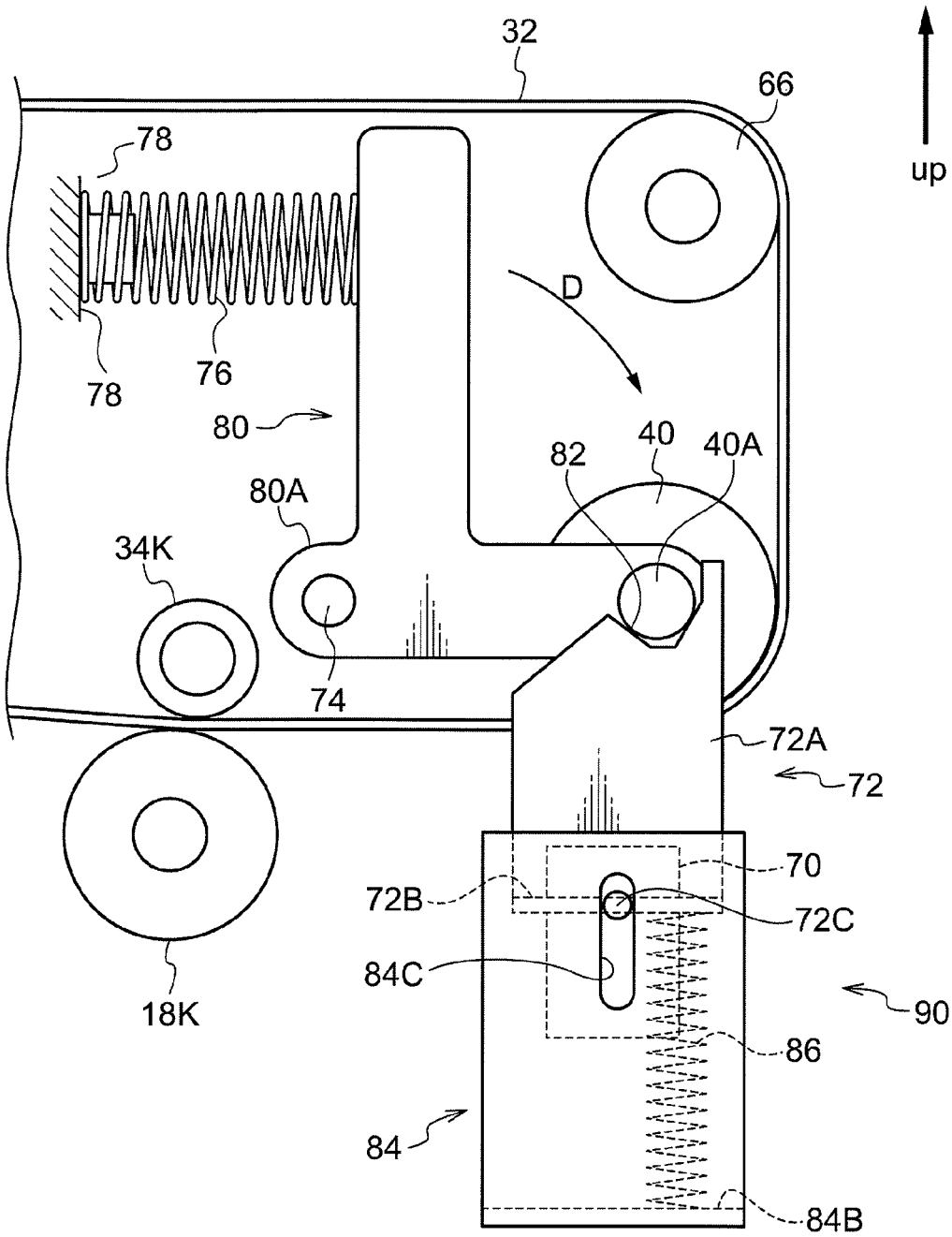
FIG. 2 is a side elevational view showing a vicinity of a tension applying roll of the primary transfer unit employed to the image forming apparatus according to the exemplary embodiment of the invention.
Figure 3:
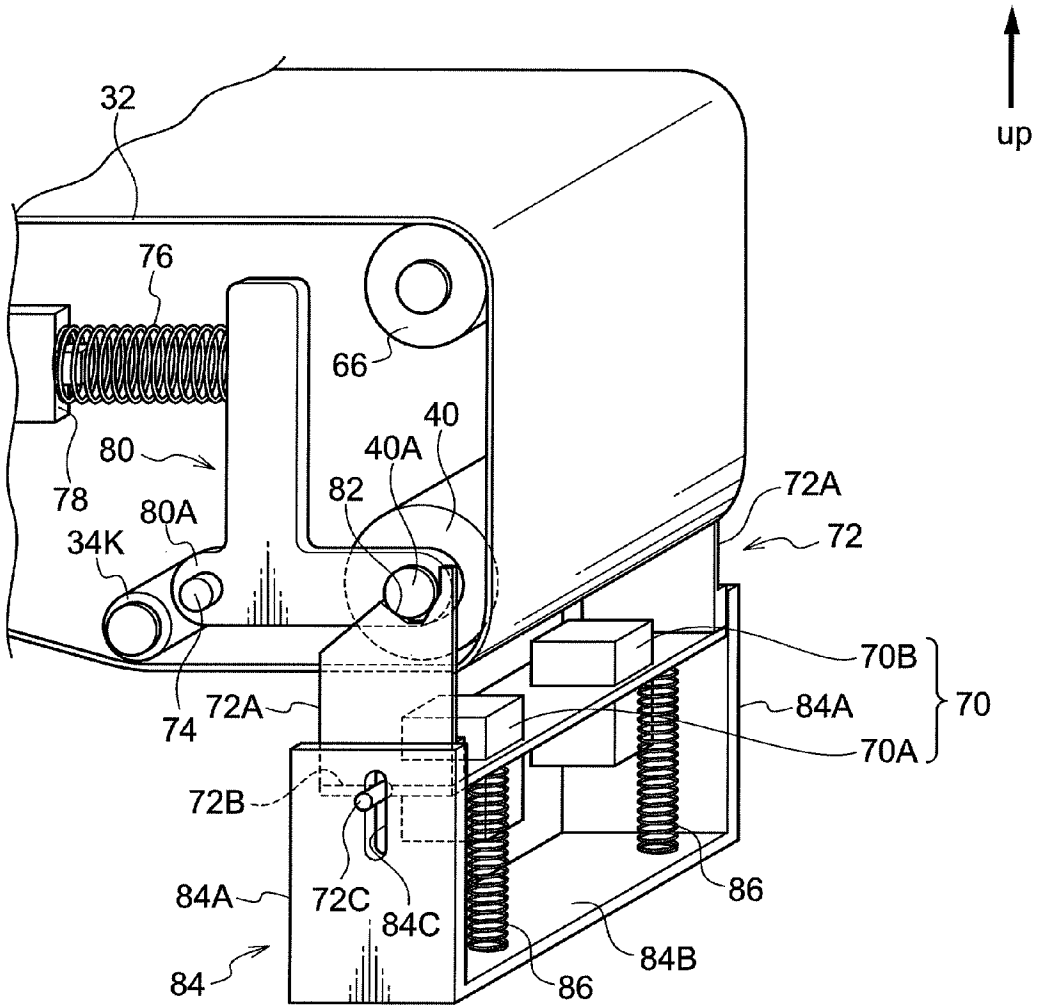
FIG. 3 is a perspective view showing a vicinity of the tension applying roll of the primary transfer unit employed to the image forming apparatus according to the exemplary embodiment of the invention.

As shown in FIG. 2 and FIG. 3, the detection member 70 for detecting the toner images, which are transferred onto the intermediate transfer belt 32, is disposed at a position facing the tension applying roll 40 with the intermediate transfer belt 32 interposed therebetween and is attached to the support member 72.

When described in detail, the support member 72 has a pair of support sections 72A having groove sections 82, which are formed at extremity end sections of the support sections 72A and into which the rotating shaft 40A of the tension applying roll 40 is fitted, as well as disposed to sandwich the tension applying roll 40 therebetween when viewed from an axial direction, and a bottom section 72B attached to base end sections of the pair of support sections 72A to bridge the support sections. A first detection member 70A, which detects the color dislocation and the irregular density of the toner images of the respective colors transferred onto the intermediate transfer belt 32, and a second detection member 70B, which detects only the color dislocation, are fixed to the bottom sections 72B side by side in the axial direction so as to face the intermediate transfer belt 32.

Further, column sections 72C, which project in the axial direction, are disposed at both the ends of the bottom sections 72B. The column sections 72C are inserted into long holes 84C formed at a holding member 84 for holding the support member 72 and extending toward the rotating shaft 40A when viewed from the axial direction.

When described in detail, the holding member 84 has a pair of standing plate sections 84A disposed to sandwich the pair of support sections 72A therebetween from the outside, and a bottom section 84B attached to base end sections of the pair of standing plate sections 84A to bridge the standing plate sections 84A. The bottom section 84B is fixed to the apparatus main body 10A by a fixing member which is not shown in the drawings. The long holes 84C described above are formed at the respective standing plate sections 84A, and the column sections 72C inserted into the long holes 84C formed at the standing plate sections 84A may move and rotate in the long holes 84C. That is, the support member 72 is movably and rotatably supported by the long holes 84C.

Further, two compression coil springs 86 are disposed between the bottom section 72B of the support member 72 and the bottom section 84B of the holding member 84 side by side in the axial direction as an example of urging members for urging the support member 72 so that the rotating shaft 40A is fitted into the groove sections 82 formed at the support members 72A.

With such a configuration, when the tension applying roll 40 rotates and moves about the shaft sections 74 to apply tension to the intermediate transfer belt 32 (to cause the intermediate transfer belt 32 to follow the movement), since the column sections 72C move and rotate in the long holes 84C, the support member 72 moves in a state in which the groove sections 82 are fitted to the rotating shaft 40A of the tension applying roll 40.

As described above, the support member 72 is positioned to the rotating shaft 40A by the movement of the support member 72, and the first detection member 70 faces the center of rotation of the tension applying roll 40 so that the distance between the first detection member 70A and the second detection member 70B, and the intermediate transfer belt 32 has a predetermined value. That is, a positioning member 90, which positions the detection member 70 with respect to the outer peripheral surface of the intermediate endless belt 32 at the portion pressed by the tension applying roll 40, includes the long holes 84C, the column sections 72C inserted into the long holes 84C, the groove sections 82 fitted to the rotating shaft 40A, and the compression coil springs 86.

Figure 7:
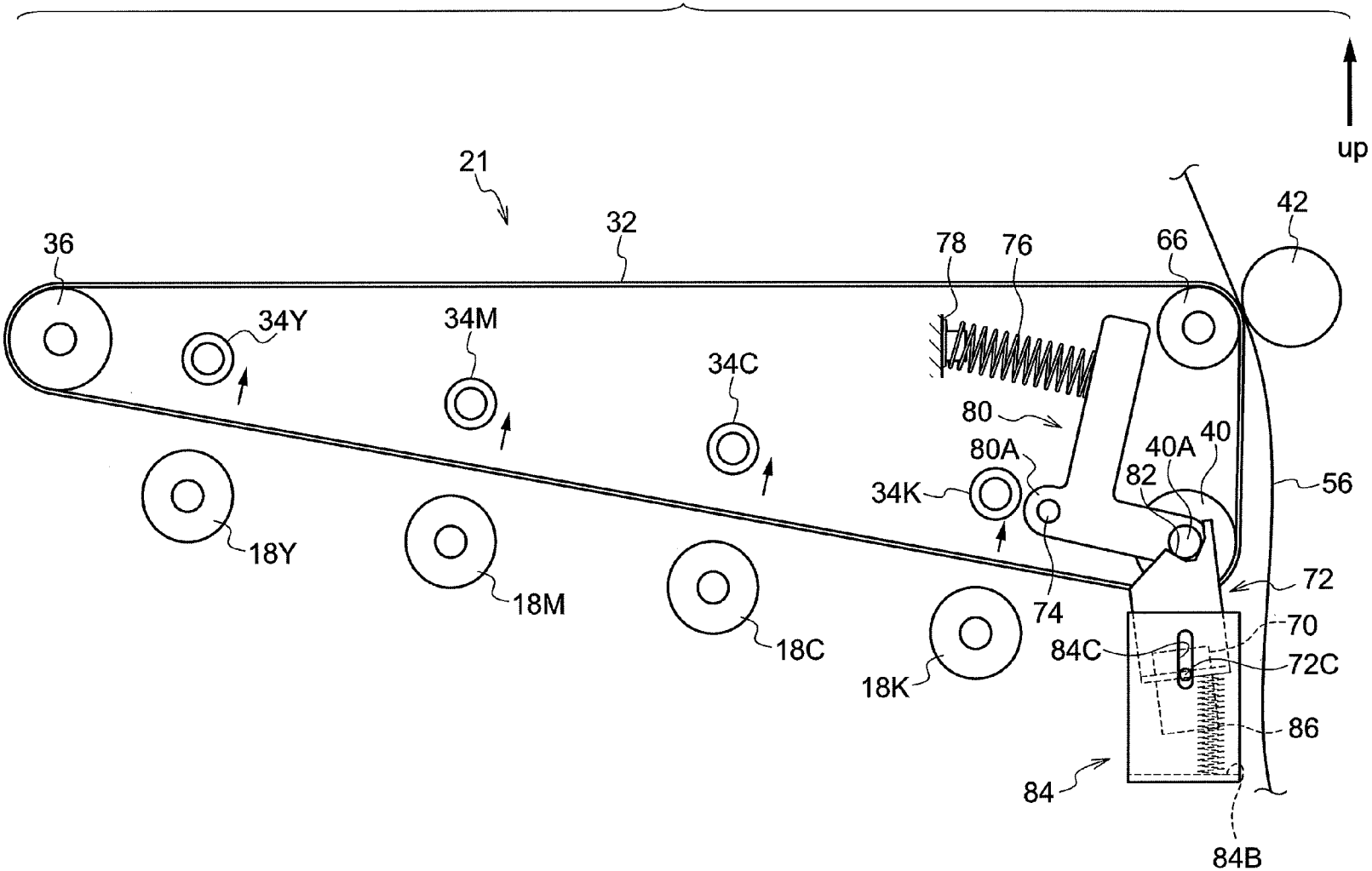
FIG. 7 is a side elevational view showing the primary transfer unit employed to the image forming apparatus according to the exemplary embodiment of the invention.
Figure 8:
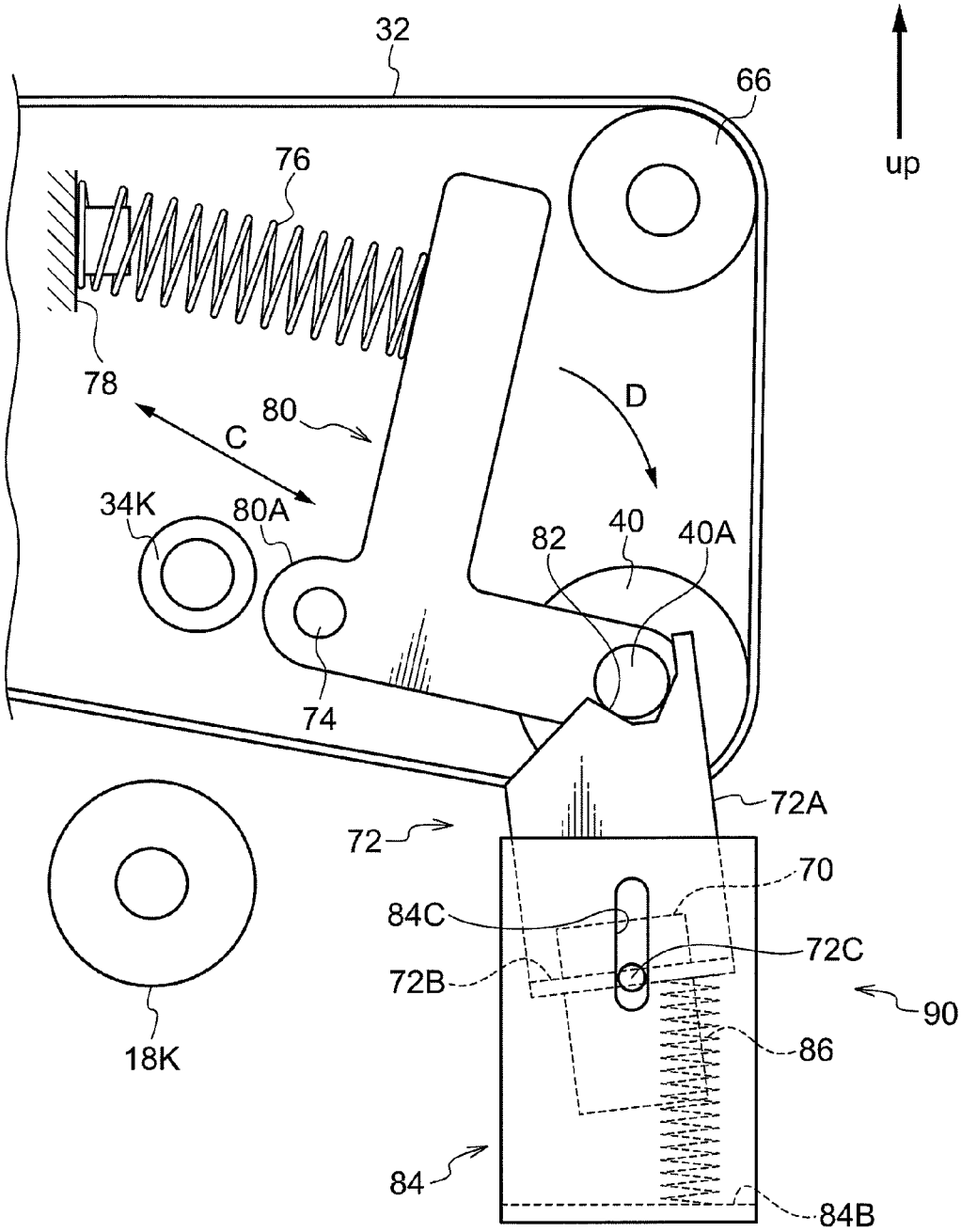
FIG. 8 is a side elevational view showing a vicinity of the tension applying roll of the primary transfer unit employed to the image forming apparatus according to the exemplary embodiment of the invention.

Further, as shown in FIG. 7 and FIG. 8, when the primary transfer unit 21 is dismounted from the apparatus main body 10A by separating all the primary transfer rolls 34 from the image holding members 18 and opening a cover (not shown in the drawings) disposed at the apparatus main body 10A, the shape of the groove sections 82 is determined so that the groove sections 82 open in the mounting/dismounting direction of the primary transfer unit 21 (in an arrow C direction shown in FIG. 8).

Figure 13:
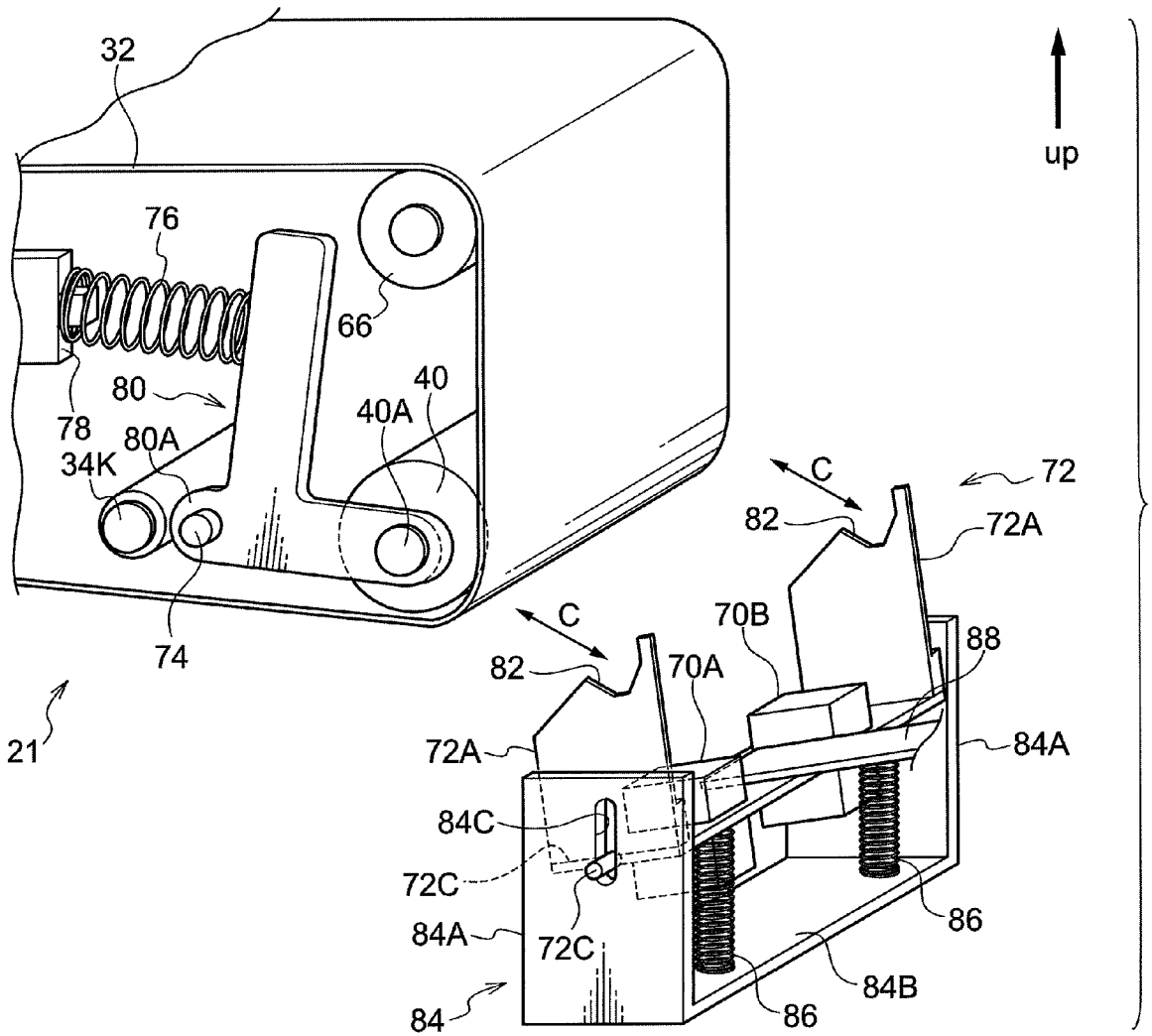
FIG. 13 is a perspective view showing a vicinity of the tension applying roll of the primary transfer unit employed to the image forming apparatus according to the exemplary embodiment of the invention.

Further, as shown in FIG. 13, a stopper 88 is disposed as an example of a keeping member which, when the primary transfer unit 21 is dismounted from the apparatus main body 10A, moves from an accommodating position in response to an instruction from control means which is not shown in the drawings, is abutted against the support member 72, and keeps the support member 72 at its position. Further, when the primary transfer unit 21 is mounted on the apparatus main body 10A, the stopper 88 moves to the accommodating position away from the support member 72 in response to an instruction from the control means.

(Operation)

Next, a motion and the like of the tension applying roll 40 when a color print and a monochrome print are executed and when the primary transfer unit 21 is mounted and dismounted will be explained.

As shown in FIG. 1, in the color print, the primary transfer rolls 34 of the respective colors are supported by the support members which are not shown in the drawings so as to press the intermediate transfer belt 32 against the image holding members 18. Due to this operation, the intermediate transfer belt 32 between the drive roll 36 and the black primary transfer roll 34K is largely curved so as to convex externally when viewed from the axial direction.

As shown in FIG. 2 and FIG. 3, when the compression coil springs 76 urge the other end of the holding member 80, the holding members 80 tend to move in an arrow D direction about the shaft sections 74 (rotation moment acts). Since the holding members 80 tend to rotate in the arrow D direction, the tension applying roll 40 rotatably supported by the one ends of the holding members 80 presses the inner peripheral surface of the intermediate transfer belt 32 and applies tension to the tension applying roll 40.

Further, the compression coil springs 86 urge the support member 72 from a lower right direction to the column sections 72C to cause a rotational force to act on the support member 72 in a direction opposite to the arrow D direction so that the groove sections 82 of the support member 72 which is movably and rotatably supported by the long holes 84C are fitted to the rotating shaft 40A of the tension applying roll 40.

Due to this operation, even if the length of the intermediate transfer belt 32 is changed by the change of an environment such as humidity and room temperature and the tension applying roll 40 is moved by the change of the environment, since the support member 72 is moved by the movement of the tension applying roll 40, the distance between the detection member 70, which is disposed facing the outer peripheral surface of the intermediate transfer belt 32 at the portion pressed by the tension applying roll 40, and the outer peripheral surface of the intermediate transfer belt 32 is kept to the predetermined distance.

In the state, the detection member 70 detects the color dislocation and the irregular density of the toner images of the respective colors transferred onto the intermediate transfer belt 32, and the control unit corrects the color dislocation and the irregular density of the toner images by controlling the image forming units 16 of the respective colors (refer to FIG. 14) bases on a result of the detection.

Figure 4:
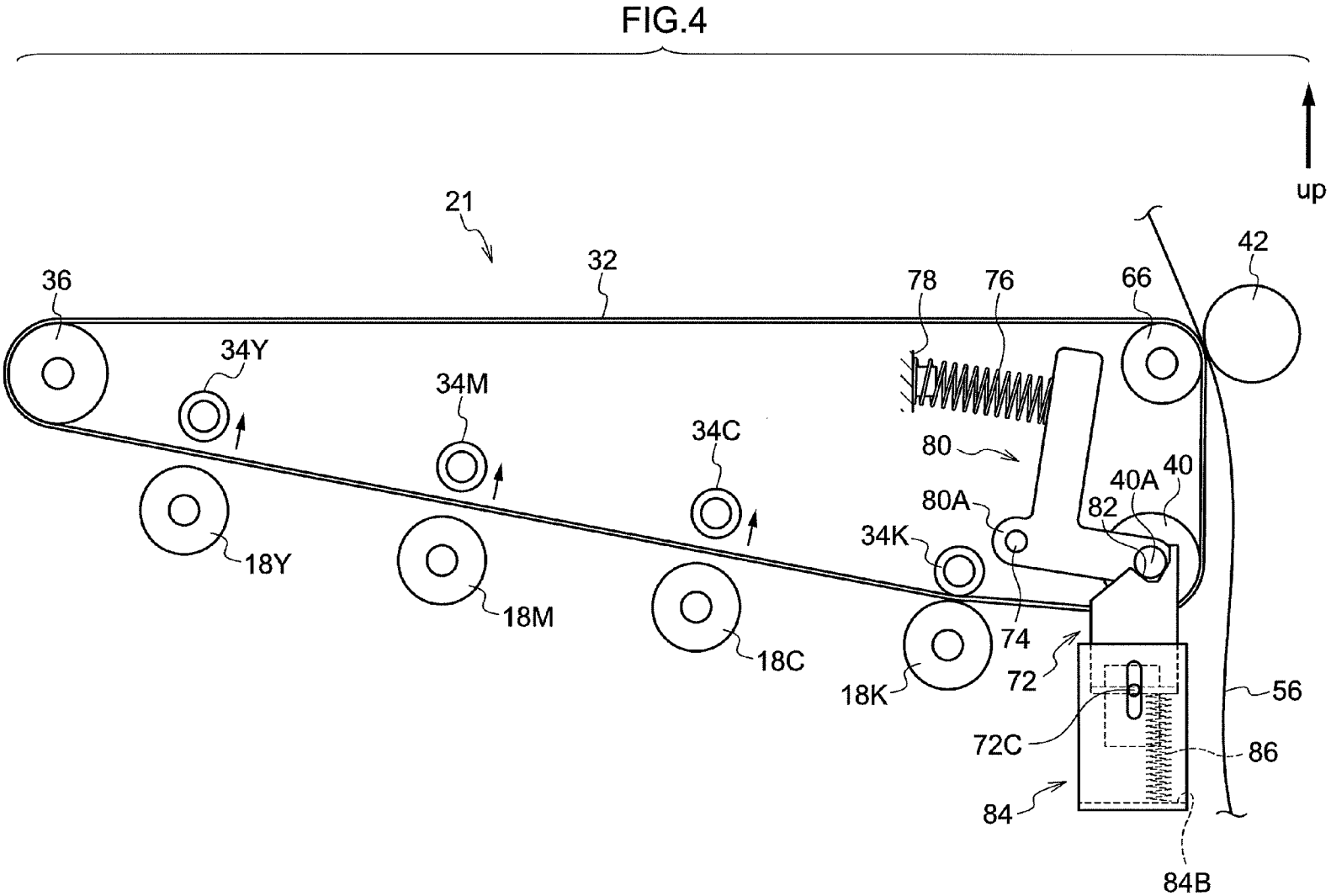
FIG. 4 is a side elevational view showing the primary transfer unit employed to the image forming apparatus according to the exemplary embodiment of the invention.

In contrast, as shown in FIG. 4, in the monochrome print, the primary transfer rolls 34Y, 34M, 34C move so as to be away from the intermediate transfer belt 32. Due to this operation, since the intermediate transfer belt 32 between the drive roll 36 and the black primary transfer roll 34K is made straight when viewed from the axial direction, the tension applied to the intermediate transfer belt 32 is lowered as compared with the time when the color print is executed.

Figure 5:
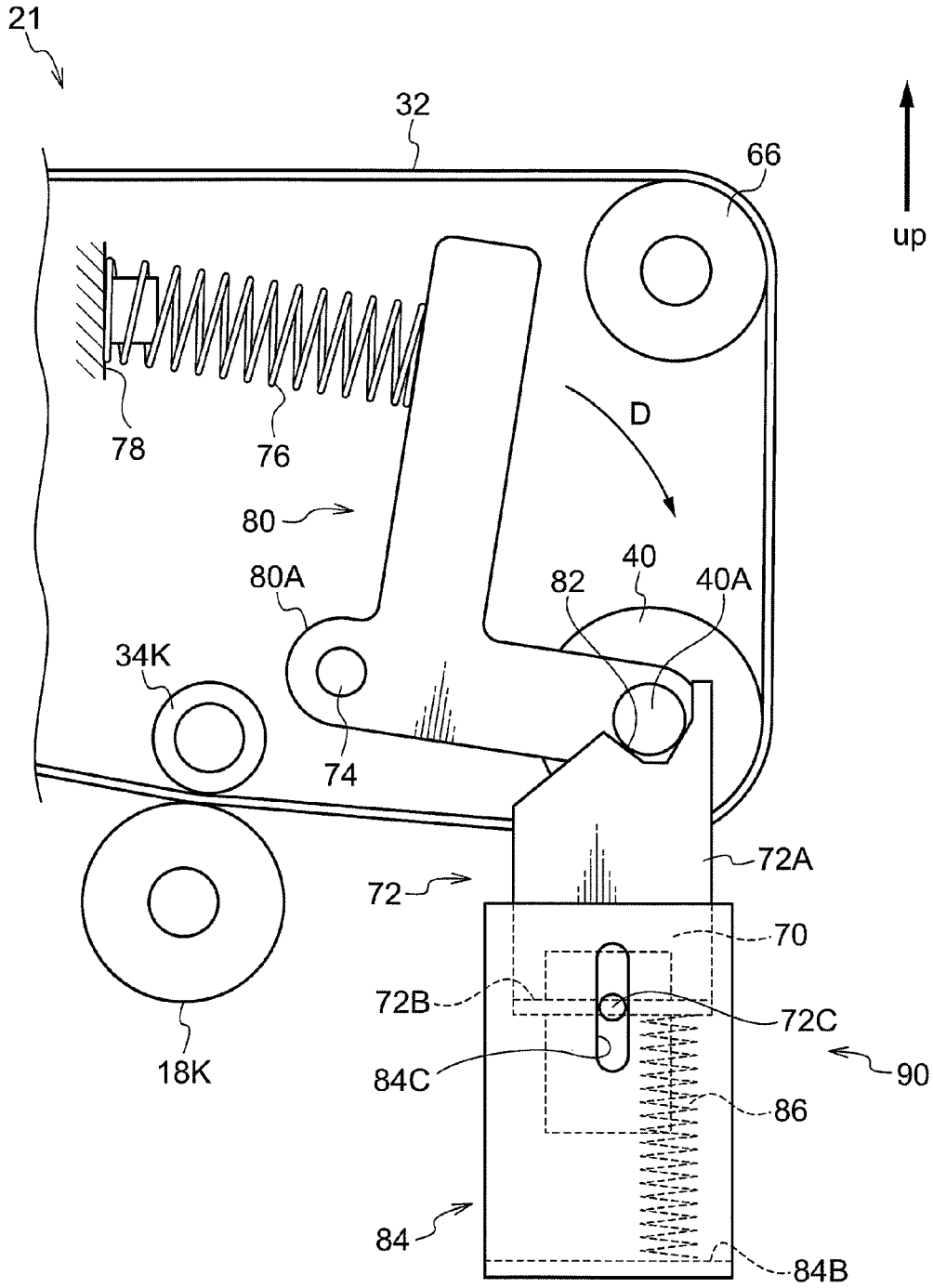
FIG. 5 is a side elevational view showing a vicinity of the tension applying roll of the primary transfer unit employed to the image forming apparatus according to the exemplary embodiment of the invention.
Figure 6:
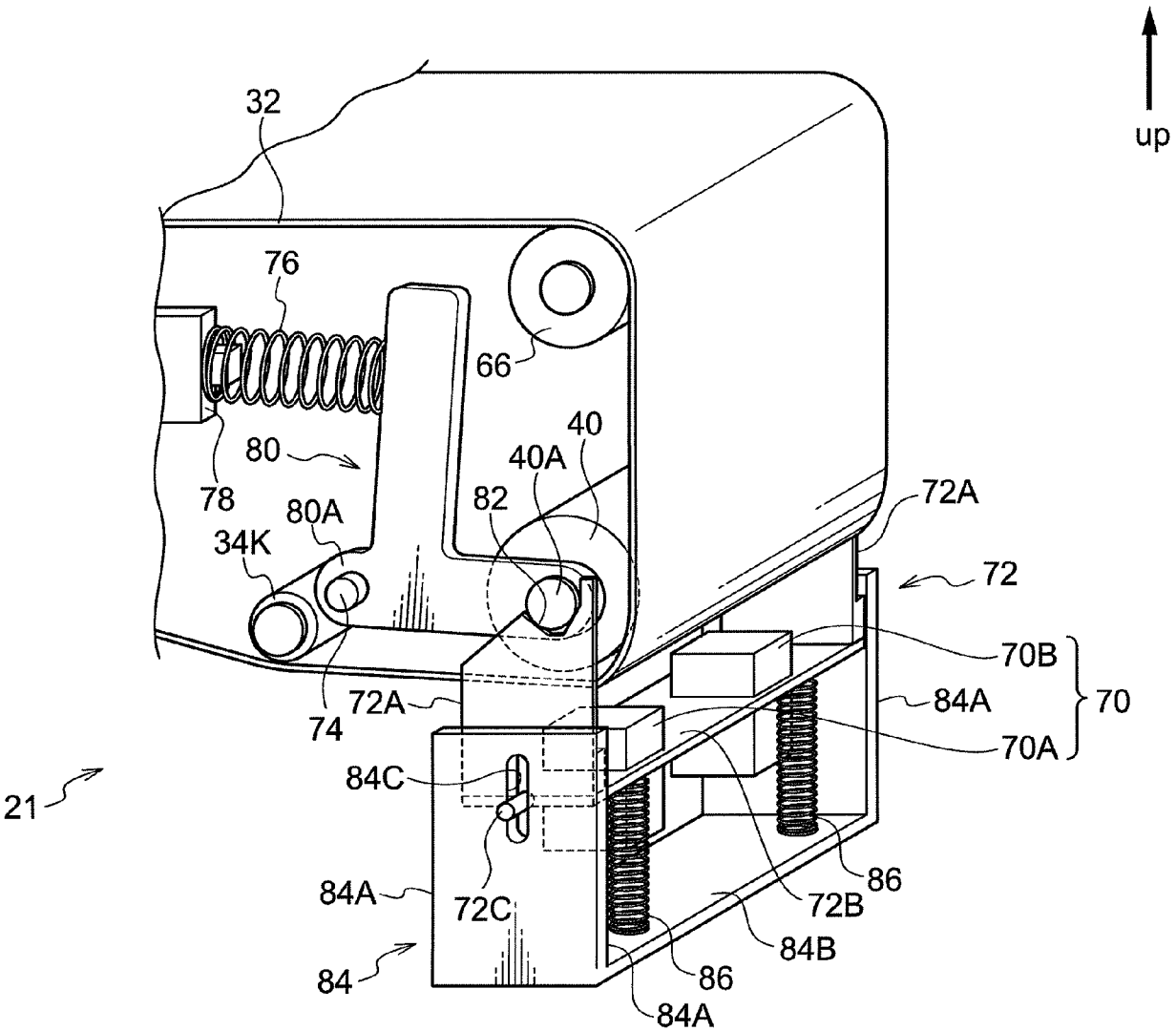
FIG. 6 is a perspective view showing a vicinity of the tension applying roll of the primary transfer unit employed to the image forming apparatus according to the exemplary embodiment of the invention.

As shown in FIG. 5 and FIG. 6, when the tension applied to the intermediate transfer belt 32 is lowered, since the compression coil springs 76 urge the other ends of the holding members 80, the holding members 80 rotate and move in the arrow D direction about the shaft sections 74. Since the holding members 80 rotate in the arrow D direction, the tension applying roll 40, which is rotatably supported by the one ends of the holding members 80, presses the inner peripheral surface of the intermediate transfer belt 32 and applies tension to the intermediate transfer belt 32. Due to this operation, predetermined tension is applied to the intermediate transfer belt 32.

Further, the rotating shaft 40A is also moved by the movement of the tension applying roll 40. Since the rotating shaft 40A moves in the arrow D direction in the arc shape, the support member 72 whose groove sections 82 are fitted to the rotating shaft 40A move downward while moving and rotating along the long holes 84C against the urging force of the compression coil springs 86.

Due to this operation, even in the case of a monochrome print, the distance between the detection member 70, which is disposed facing the outer peripheral surface of the intermediate transfer belt 32 at the portion pressed by the tension applying roll 40, and the outer peripheral surface of the intermediate transfer belt 32 is maintained at the predetermined distance which is equal to the distance in the case when a color print is executed.

In the state, the detection member 70 detects the color dislocation (positional offset) and the irregular density of a black toner image transferred onto the intermediate transfer belt 32, and the control unit corrects the color dislocation and the irregular density of the toner image by controlling the image forming unit 16K.

In contrast, as shown in FIG. 7, when the primary transfer unit 21 is mounted and dismounted, the primary transfer rolls 34Y, 34M, 34C, 34K move so as to be away from the intermediate transfer belt 32. Due to this operation, since the intermediate transfer belt 32 between the drive roll 36 and the tension applying roll 40 is made straight when viewed from the axial direction, the tension applied to the intermediate transfer belt 32 is lowered as compared with the time when the monochrome print is executed.

Figure 9:
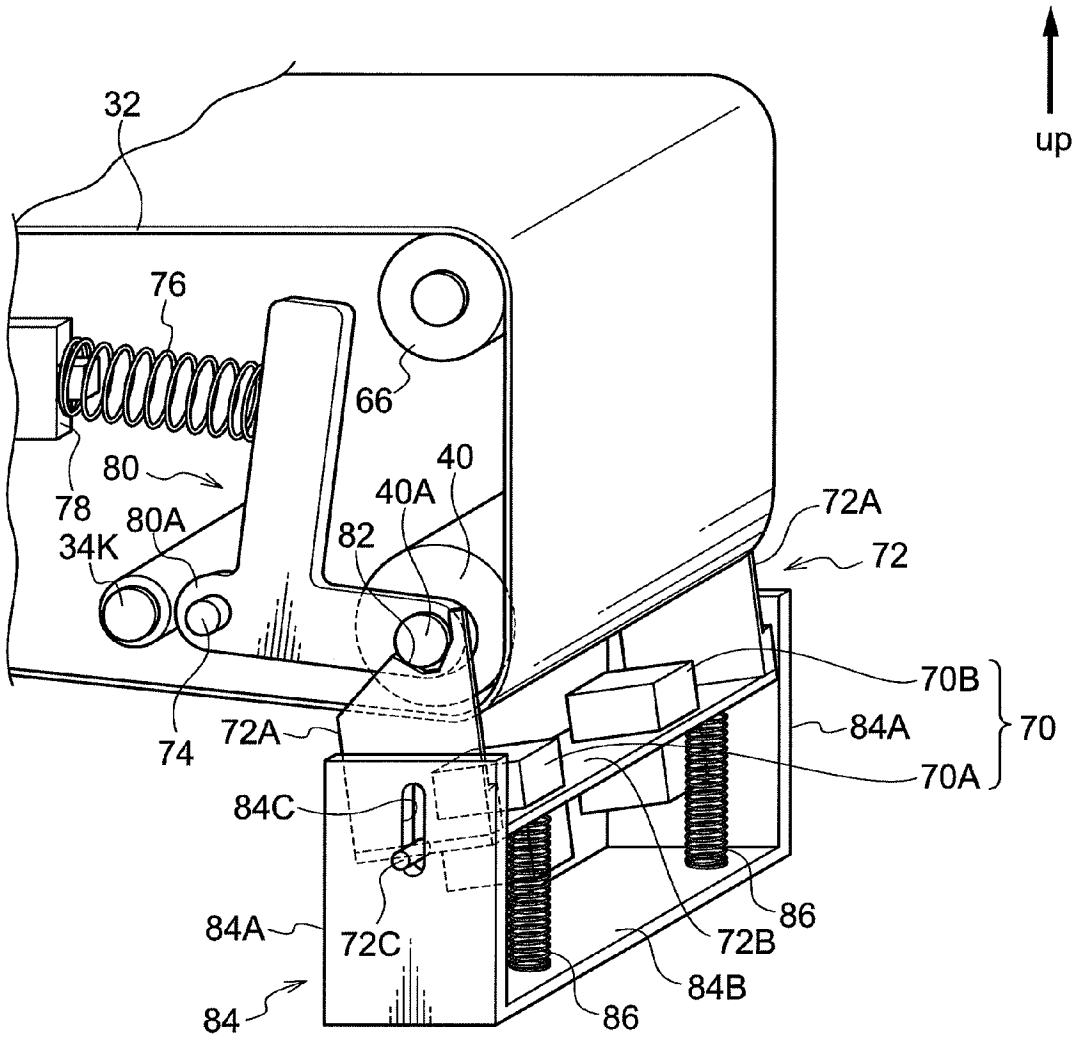
FIG. 9 is a perspective view showing a vicinity of the tension applying roll of the primary transfer unit employed to the image forming apparatus according to the exemplary embodiment of the invention.

As shown in FIG. 8 and FIG. 9, when the tension applied to the intermediate transfer belt 32 is lowered, since the compression coil springs 76 urge the other ends of the holding members 80, the holding members 80 rotate and move in the arrow D direction about the shaft sections 74. When the holding members 80 rotate in the arrow D direction, the tension applying roll 40, which is rotatably supported to the one ends of the holding members 80, presses the inner peripheral surface of the intermediate transfer belt 32. Due to this operation, the predetermined tension is applied to the intermediate transfer belt 32. The holding members 80 are configured so that the distance from the shaft sections to the other ends of the holding members 80 is made longer than the distance from the shaft sections 74 to the one ends of the holding members 80. Accordingly, necessary tension is applied to the intermediate transfer belt 32 by a principle of a lever using the shaft sections 74 as fulcrums without using compression coil springs having an urging force as large as the tension. That is, compression coil springs having a small spring constant may be used as compared with a case that the tension applying roll 40 is directly urged. In the state, the groove sections 82 open in the mounting/dismounting direction (in the arrow C direction shown by FIG. 8) of the primary transfer unit 21.

Figure 10:
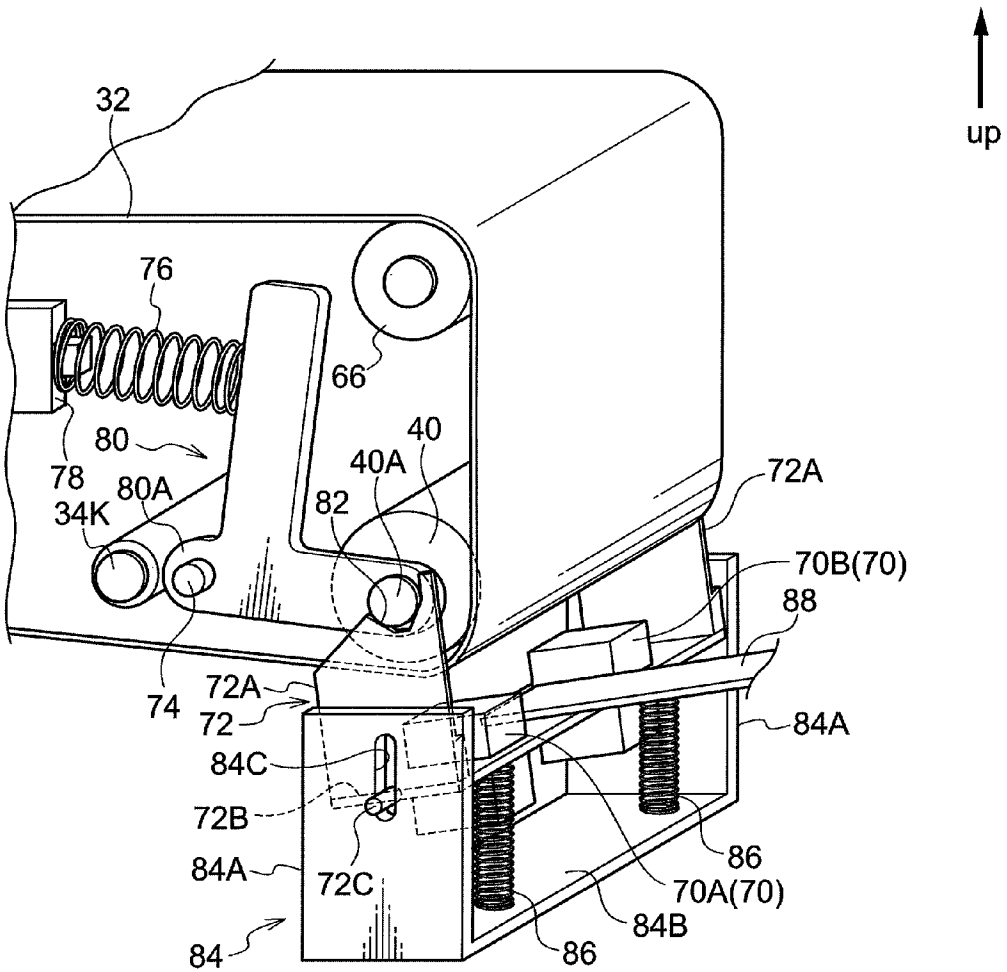
FIG. 10 is a perspective view showing a vicinity of the tension applying roll of the primary transfer unit employed to the image forming apparatus according to the exemplary embodiment of the invention.

Further, when it is intended to dismount the primary transfer unit 21 from the apparatus main body 10A, the stopper 88 moves from the accommodating position in response to an instruction from the control unit and is abutted against the bottom section 72B of the support member 72, thereby holding the support member 72 at its position as shown in FIG. 10.

Figure 11:
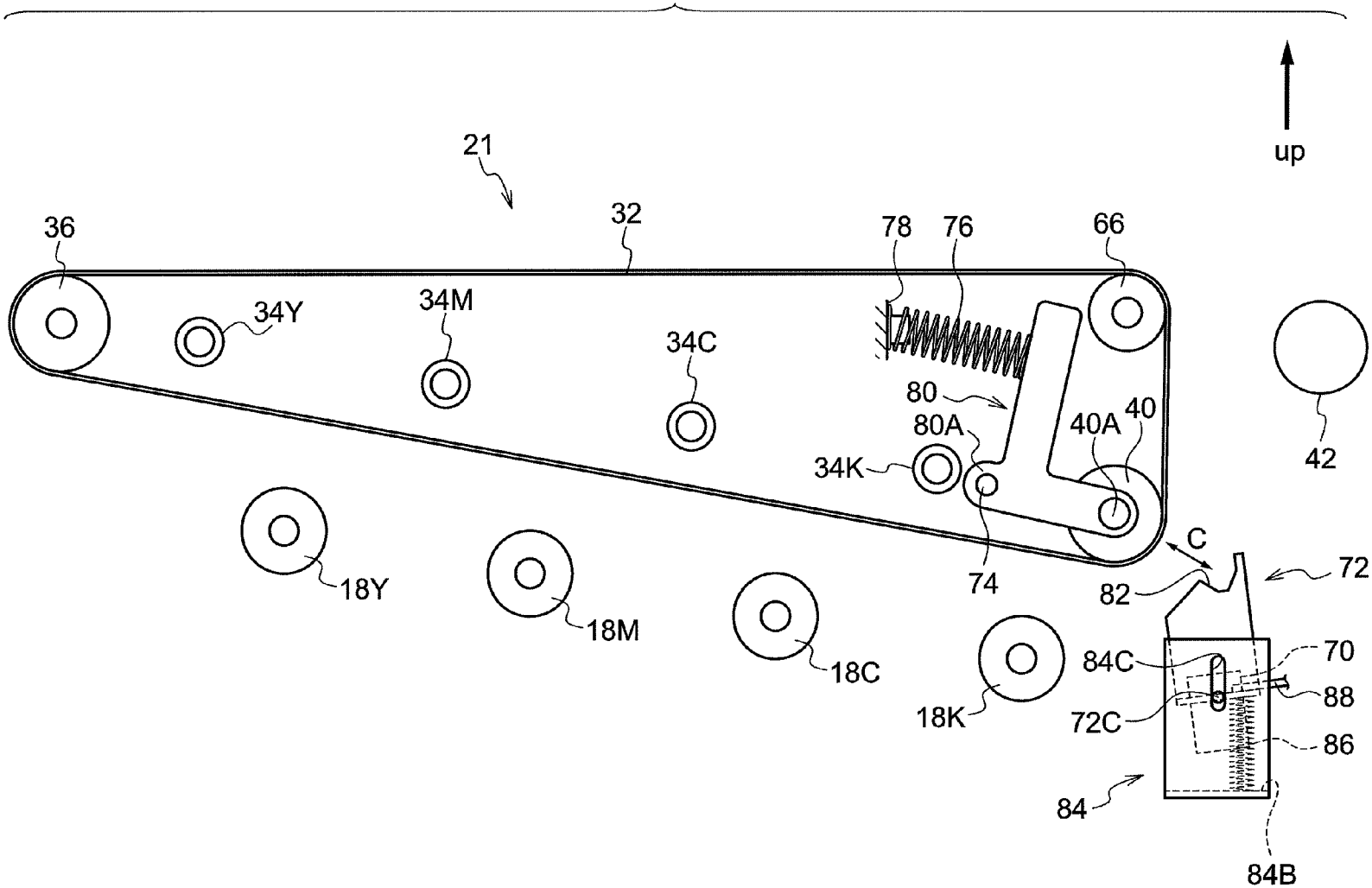
FIG. 11 is a side elevational, view showing the primary transfer unit employed to the image forming apparatus according to the exemplary embodiment of the invention.
Figure 12:
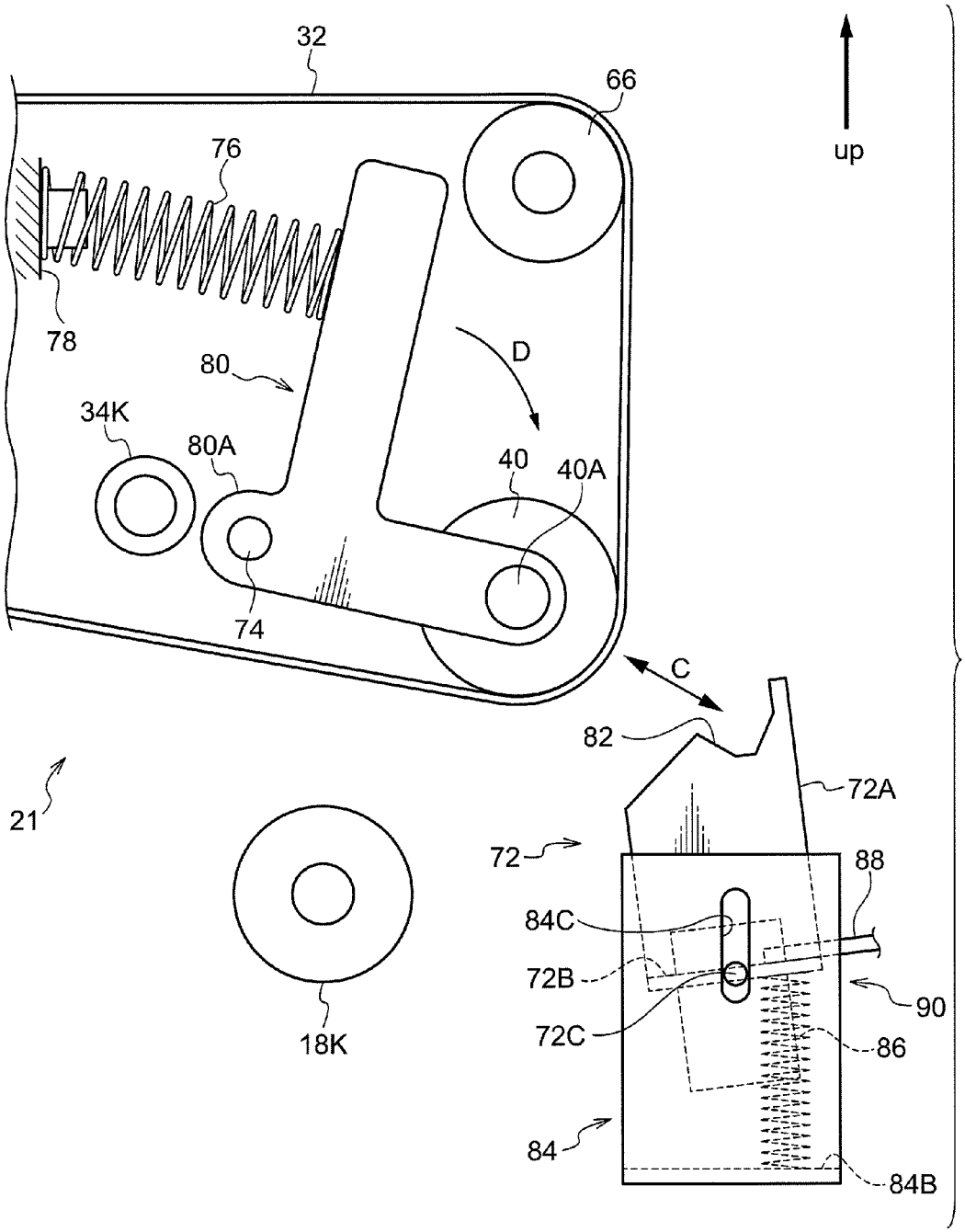
FIG. 12 is a side elevational view showing a vicinity of the tension applying roll of the primary transfer unit employed to the image forming apparatus according to the exemplary embodiment of the invention.

As shown in FIG. 11, FIG. 12 and FIG. 13, when the cover of the apparatus main body 10A is dismounted and the primary transfer unit 21 is moved in the arrow C direction, the rotating shaft 40A of the tension applying roll 40 is separated from the groove sections 82, and the primary transfer unit 21 is dismounted from the apparatus main body 10A.

Even if the primary transfer unit 21 is dismounted from the apparatus main body 10A, since the stopper 88 is abutted against the bottom section 72B of the support member 72, the support member 72 is held in a state in which the groove sections 82 open in the mounting/dismounting direction of the primary transfer unit 21.

In contrast, when the primary transfer unit 21 is mounted on the apparatus main body 10A, the primary transfer unit 21 is moved in the arrow C direction so that the primary transfer unit 21 approaches the support member 72. As shown in FIG. 8 and FIG. 9, when the primary transfer unit 21 is moved in the arrow C direction, the rotating shaft 40A of the tension applying roll 40 is fitted into the groove sections 82 which open in the mounting/dismounting direction of the primary transfer unit 21, and the primary transfer unit 21 is mounted on the apparatus main body 10A.

When the primary transfer unit 21 is mounted on the apparatus main body 10A, the stopper 88 moves to the accommodating position away from the support member 72 in response to an instruction of the control means. Due to this operation, the support member 72 is moved by the movement of the tension applying roll 40.

As described above, even if the tension applying roll 40 is moved by the change of the environment such as humidity and room temperature or the change of the print mode (the color print and the monochrome print), since the support member 72 to which the detection member 70 is attached is moved by the movement of the tension applying roll 40, the distance between the detection member 70 and the outer peripheral surface of the intermediate transfer belt 32 is maintained at the predetermined distance so that the detection accuracy of toner images detected by the detection member 70 is kept.

Further, when the primary transfer unit 21 is dismounted from the apparatus main body 10A, since the shape of the groove sections 82 is determined so that the groove sections 82 open in the mounting/dismounting direction of the primary transfer unit 21 (the arrow C direction shown in FIG. 8), the primary transfer unit 21 is easily dismounted from the apparatus main body 10A.

Further, since the tension applying roll 40 moves about the shaft sections 74 in the arc shape and presses the inner peripheral surface of the intermediate transfer belt 32, the motion of the tension applying roll 40 is stabilized without being tilted in comparison with a case that the tension applying roll 40 move straight. Accordingly, the tension applying roll 40 presses the inner peripheral surface of the intermediate transfer belt 32 by a stable force. In the configuration, since the support member 72 moves and rotates following the movement of the tension applying roll 40 and the detection member 70 faces the center of rotation of the tension applying roll 40 at all times, the distance between the detection member 70 and the outer peripheral surface of the intermediate transfer belt 32 is maintained at the predetermined distance.

Note that although the invention has been explained in detail as to the specific exemplary embodiment, it is apparent to persons skilled in the art that the invention is by no means limited to the exemplary embodiment and other various exemplary embodiments are possible within the scope of the invention. For example, although the case that the toner images formed onto the intermediate transfer belt 32 are detected has been explained as an example in the exemplary embodiment, the invention is by no means limited to the example, and the structure may be used in a case that toner images formed onto a sheet transport belt are detected.

What is claimed is:

1. An image forming apparatus comprising:

an endless belt that travels circularly by a drive member and has an outer peripheral surface on which an image is formed;

a tension applying member around which the endless belt is trained and that applies tension to the endless belt by pressing an inner peripheral surface of the endless belt;

a detection member that detects the image formed on the outer peripheral surface of the endless belt, and wherein the detection member is disposed at a position facing the tension applying member;

a support member to which the detection member is attached and that movably supports the detection member in accordance with the movement of the tension applying member;

a positioning member that positions the detection member with respect to the outer peripheral surface of the endless belt at a portion pressed by the tension applying member; and a holding member at which a shaft section is disposed and that rotatably supports the tension applying member about the shaft section, wherein the support member is rotated in accordance with the movement of the tension applying member, and wherein the holding member rotates about the shaft section so that the tension applying member presses the inner peripheral surface of the endless belt.

2. The image forming apparatus of claim 1, comprising a belt unit that comprises the endless belt and the tension applying member and that is mounted on and dismounted from the apparatus main body.

3. The image forming apparatus of claim 2, wherein:

the support member comprises a groove section into which a shaft of the tension applying member is fitted and that has an opening in a mounting/dismounting direction of the belt unit.

4. The image forming apparatus of claim 3, wherein the positioning member comprises an urging member that urges the support member so that the shaft of the tension applying member is fitted into the groove section formed at the support member.

5. The image forming apparatus of claim 1, wherein the tension applying member is disposed at one end of the holding member with the shaft section of the holding member interposed therebetween, and an urging member that urges the holding member is disposed at an other end of the holding member.

6. The image forming apparatus of claim 5, wherein a distance from the shaft section to the other end of the holding member is longer than a distance from the shaft section to the one end of the holding member.

7. The image forming apparatus of claim 5, wherein the holding member is formed in an L-shape, a projecting section is disposed at the corner of the holding member, and the shaft section is positioned to the projecting section.

8. The image forming apparatus of claim 1, wherein the support member is rotated following the movement of the tension applying member.

9. The image forming apparatus of claim 1, further comprising a holding member that movably and rotatably support the support member.

10. The image forming apparatus of claim 9, wherein the holding member further comprises long holes, and the support member further comprises a column section inserted into the long holes.

11. The image forming apparatus of claim 1, wherein the tension applying member rotates and moves about a shaft section such that the tension applied to the endless belt follows the movement of the tension applying member.

12. The image forming apparatus of claim 1, wherein the tension applying member is configured to move toward the endless belt to increase the applied tension.

13. The image forming apparatus of claim 1, wherein the support member is rotated in accordance with the movement of the tension applying member that is in a mounted configuration on the apparatus main body.

14. The image forming apparatus of claim 1, wherein the drive member is a drive roller for driving the endless belt.

15. The image forming apparatus of claim 1, wherein the tension applying member is a tension roller.

16. An image forming apparatus comprising:

an endless belt that travels circularly by a drive member and has an outer peripheral surface on which an image is formed;

a tension applying member around which the endless belt is trained and that applies tension to the endless belt by pressing an inner peripheral surface of the endless belt;

a detection member that detects the image formed on the outer peripheral surface of the endless belt, and wherein the detection member is disposed at a position facing the tension applying member;

a support member to which the detection member is attached and that movably supports the detection member in accordance with the movement of the tension applying member, the support member comprises a groove section into which a shaft of the tension applying member is fitted and that has an opening in a mounting/dismounting direction of the belt unit;

a positioning member that positions the detection member with respect to the outer peripheral surface of the endless belt at a portion pressed by the tension applying member;

a keeping member that keeps the support member so that the opening of the groove section formed at the support member faces the mounting/dismounting direction of the belt unit in a case in which the belt unit is mounted on and dismounted from the apparatus main body; and a belt unit that comprises the endless belt and the tension applying member and that is mounted on and dismounted from the apparatus main body.

17. The image forming apparatus of claim 16, wherein the keeping member is a stopper that holds the support member by being abutted against the support member when the belt unit is dismounted from the apparatus main body.

18. An image forming apparatus comprising:

an endless belt that travels circularly by a drive member and has an outer peripheral surface on which an image is formed;

a tension applying member around which the endless belt is trained and that applies tension to the endless belt by pressing an inner peripheral surface of the endless belt;

a detection member that detects the image formed on the outer peripheral surface of the endless belt, and wherein the detection member is disposed at a position facing the tension applying member;

a support member to which the detection member is attached and that movably supports the detection member in accordance with the movement of the tension applying member;

a positioning member that positions the detection member with respect to the outer peripheral surface of the endless belt at a portion pressed by the tension applying member;

a holding member that movably and rotatably support the support member; and coil springs disposed between a bottom section of the support member and a bottom section of the holding member side by side in an axial direction.

* * * * *